US009459043B2

(12) United States Patent
Briglia et al.

(10) Patent No.: US 9,459,043 B2
(45) Date of Patent: Oct. 4, 2016

(54) METHOD AND APPARATUS FOR PRODUCING CARBON MONOXIDE BY CRYOGENIC DISTILLATION USING A DISTILLATION COLUMN SYSTEM SUPPLIED WITH A MIXTURE OF WHICH THE MAIN COMPONENTS ARE AT LEAST HYDROGEN AND CARBON MONOXIDE

(75) Inventors: Alain Briglia, Corze (FR); Arthur Darde, Paris (FR); Natacha Haik-Beraud, Champigny-sur-Marne (FR); Marie-Khuny Khy, Shanghai (CN)

(73) Assignee: L'Air Liquide Société Anonyme Pour L'Étude Et L'Exploitation Des Procedes Georges Claude, Paris (FR)

( * ) Notice: Subject to any disclaimer, the term of this patent is extended or adjusted under 35 U.S.C. 154(b) by 1085 days.

(21) Appl. No.: 12/525,330

(22) PCT Filed: Jan. 30, 2008

(86) PCT No.: PCT/FR2008/050148

§ 371 (c)(1),
(2), (4) Date: Jan. 15, 2010

(87) PCT Pub. No.: WO2008/099124

PCT Pub. Date: Aug. 21, 2008

(65) Prior Publication Data

US 2010/0150813 A1 Jun. 17, 2010

(30) Foreign Application Priority Data

Feb. 1, 2007 (FR) ..... 07 52999

(51) Int. Cl.
*C01B 31/18* (2006.01)
*F25J 3/02* (2006.01)

(52) U.S. Cl.
CPC ..... *F25J 3/0223* (2013.01); *F25J 3/0252* (2013.01); *F25J 3/0257* (2013.01); *F25J 3/0261* (2013.01); *F25J 2205/04* (2013.01); *F25J 2205/30* (2013.01); *F25J 2210/42* (2013.01); *F25J 2270/904* (2013.01); *F25J 2280/02* (2013.01)

(58) Field of Classification Search
None
See application file for complete search history.

(56) References Cited

U.S. PATENT DOCUMENTS

| | | | | |
|---|---|---|---|---|
| 4,623,370 | A | 11/1986 | Allen | |
| 5,437,160 | A * | 8/1995 | Darredeau et al. | 62/656 |
| 6,062,042 | A * | 5/2000 | McNeil et al. | 62/625 |
| 6,073,461 | A * | 6/2000 | McNeil et al. | 62/625 |
| 2007/0033967 | A1 * | 2/2007 | Briglia | 62/617 |

FOREIGN PATENT DOCUMENTS

| | | |
|---|---|---|
| DE | 2814660 | 10/1979 |
| DE | 3741906 | 6/1989 |
| FR | 2895067 | 6/2007 |

OTHER PUBLICATIONS

PCT Search Report for PCT/FR2008/050148.

* cited by examiner

*Primary Examiner* — Melvin C Mayes
*Assistant Examiner* — Kenneth Vaden

(57) ABSTRACT

A method and apparatus for producing carbon monoxide by cryogenic distillation is presented.

15 Claims, 1 Drawing Sheet

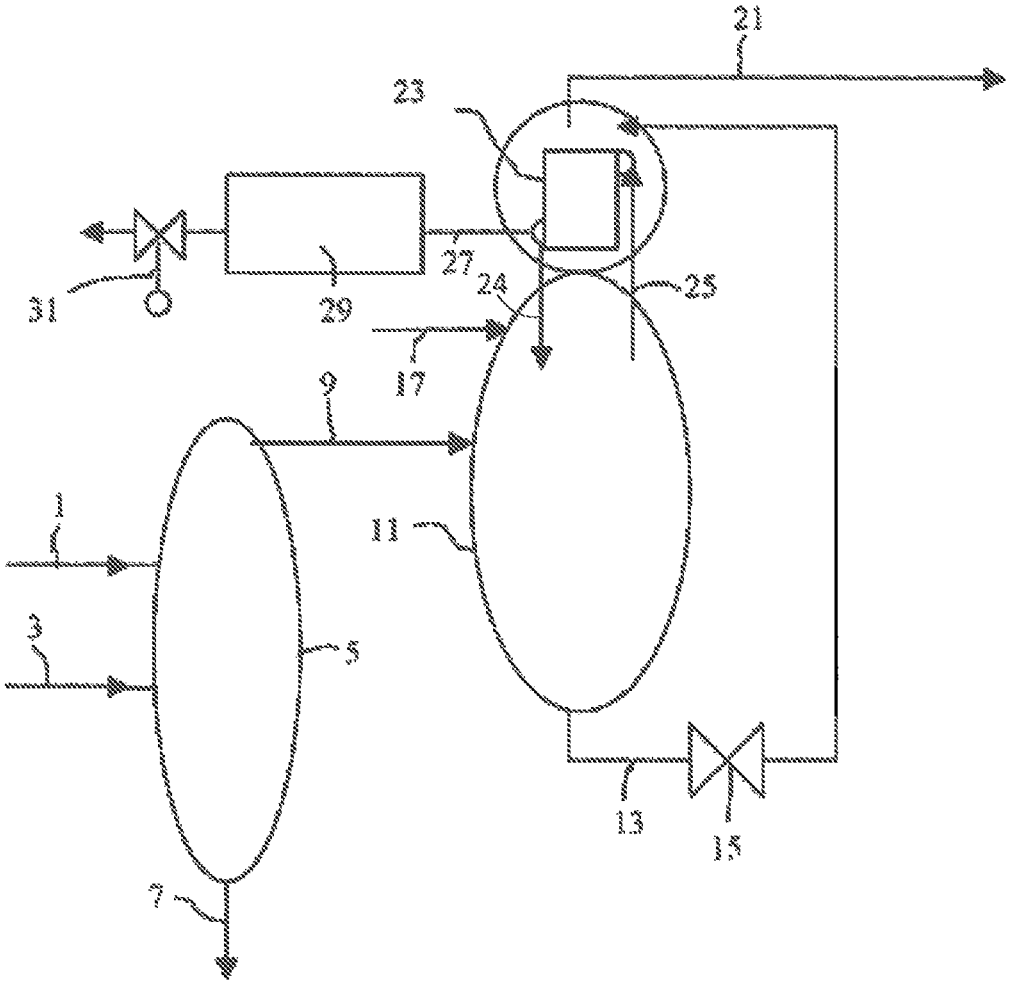
21
23
27
24
25
31
29
17
9
1
11
3
5
13
15
7

METHOD AND APPARATUS FOR PRODUCING CARBON MONOXIDE BY CRYOGENIC DISTILLATION USING A DISTILLATION COLUMN SYSTEM SUPPLIED WITH A MIXTURE OF WHICH THE MAIN COMPONENTS ARE AT LEAST HYDROGEN AND CARBON MONOXIDE

This application is a §371 of International PCT Application PCT/FR2008/050148, filed Jan. 30, 2008.

FIELD OF THE INVENTION

Background

The present invention relates to a method and apparatus for producing carbon monoxide by cryogenic distillation. In known methods for producing hydrogen and/or carbon monoxide by cryogenic distillation, a denitrogenation column is frequently used in order to obtain products very low in nitrogen from a mixture to be separated that is contaminated with nitrogen.

It may however happen that the nitrogen content of the mixture to be separated is extremely small or even zero from time to time, while the unit has been designed with a denitrogenation column. This will thus be the case with a mixture to be separated produced by an SMR, fed temporarily with naphtha. Since regulation of the pressure of the denitrogenation column is made by controlling the nitrogen purge, it will no longer be possible to keep the pressure of this column constant. Since this pressure controls that of the $CO/CH_4$ column, generally upstream of the denitrogenation column, the operation of the unit will be caused to deteriorate considerably by probable fluctuations.

SUMMARY OF THE INVENTION

According to the invention, in order to solve the problem of lack of nitrogen in the feed gas, nitrogen is injected upstream of the denitrogenation column, preferably in the circuit followed by CO (from the synthesis gas or from the cycle), preferably at a low pressure, in this way enabling the denitrogenation column to operate.

According to one object of the invention, a method is provided for producing carbon monoxide by cryogenic distillation using a system of distillation columns fed with a mixture of at least hydrogen and carbon monoxide as the main components and at least part of the time nitrogen, wherein the mixture is separated in a system of columns comprising a denitrogenation column for producing a nitrogen-rich flow and a nitrogen-lean flow and a carbon monoxide-rich flow is withdrawn from the system of columns to serve as the product, characterized in that if the nitrogen content of the mixture falls below a given threshold, a nitrogen-rich fluid coming from an external source other than the source from which the mixture comes, is conveyed upstream of or into the denitrogenation column.

According to other optional objects:

- the nitrogen-rich fluid is injected into a flow feeding the denitrogenation column or the nitrogen-rich fluid is injected directly into the denitrogenation column;
- the nitrogen-rich fluid is injected at a temperature above −170° C., optionally above 0° C.;
- the nitrogen-rich fluid is a liquid or gas;
- if the nitrogen-rich flow is reduced below a given flow rate, the nitrogen-rich fluid coming from an external source other than the source from which the mixture comes, is conveyed upstream of the denitrogenation column;
- the column system makes it possible to achieve partial condensation or methane washing upstream of the denitrogenation column.

According to another object of the invention, an installation for producing carbon monoxide by cryogenic distillation is provided, comprising a system of distillation columns, means for feeding the system of columns with a mixture comprising at least hydrogen and carbon monoxide as the main components and for at least part of the time nitrogen, the system of columns comprising a denitrogenation column for producing a nitrogen-rich flow and a nitrogen-lean flow and means for withdrawing a carbon monoxide-rich flow from the system of columns to serve as the product, and means for bringing a nitrogen-rich fluid coming from an external source other than the source from which the mixture comes, upstream of the denitrogenation column or as far as the denitrogenation column, characterized in that it comprises means for measuring:

i) the nitrogen content of the mixture, of a fluid from which the mixture is derived or of a fluid (9) feeding the denitrogenation column or ii) the purge flow rate of a condenser (23) of the denitrogenation column or of the fluid feeding the denitrogenation column or iii) the opening of an expansion valve (31) of the purge of a condenser of the denitrogenation column and control means capable of conveying the nitrogen-rich fluid (17) coming from an external source other than the source from where the mixture comes, upstream of the denitrogenation column and/or to the denitrogenation column according to the measured content or the measured flow rate or the measured opening.

According to another object of the invention, in the installation:

- the means for bringing a nitrogen-rich fluid coming from an external source are connected to an inlet of the denitrogenation column;
- the installation includes means for measuring the nitrogen-rich flow rate and control means capable of conveying the nitrogen-rich fluid coming from an external source other than the source from where the mixture comes upstream of the denitrogenation column if the measured flow rate is less than a given threshold;
- the column system includes means for carrying out partial condensation or methane washing upstream of the denitrogenation column.

BRIEF DESCRIPTION OF THE FIGURES

The sole FIGURE illustrates an apparatus for producing carbon monoxide in accordance with one embodiment of the present invention.

DETAILED DESCRIPTION OF THE INVENTION

For a further understanding of the nature and objects for the present invention, reference should be made to the detailed description, taken in conjunction with the accompanying drawing, in which like elements are given the same or analogous reference numbers and wherein:

The apparatus comprises at least two distillation columns, comprising a $CO/CH_4$ column 5 and a denitrogenation column 11.

The apparatus may form part of an installation with a methane washing step or a partial condensation step upstream of the $CO/CH_4$ column. The denitrogenation column may also be situated upstream of the $CO/CH_4$ column.

The $CO/CH_4$ column is fed by two flows 1, 3 at different levels and produces a liquid rich in methane 7 and a fluid 9 rich in carbon monoxide 9 but containing nitrogen at least part of the time. The fluid 9 is conveyed to the denitrogenation column 11 in the upper part of the column. The vessel liquid 13, which contains primarily carbon monoxide, is flowed across valve 15 and then conveyed to a head condenser 23 of the denitrogenation column 11 in order to condense the nitrogen vapor 25. Nitrogen vapor 25, which will have minor amounts of carbon monoxide, is condensed in condenser 23 by thermal contact with the vessel liquid 13 and then reintroduced via line 24 into denitrogenation column 11 as a reflux. A purge flow 27, which is comprised primarily of nitrogen and will have minor amounts of carbon monoxide, is withdrawn from the condenser 23 and conveyed to a heat exchanger 29 where it evaporates and is expanded in a valve 31. The pressure of the denitrogenation column 11 is maintained by means of the purge flow 27.

If the nitrogen content of the flow 9 and/or the flow 9 itself and/or the purge flow 27 falls below a given threshold, a flow of liquid or gaseous nitrogen 17 is conveyed to the head of the denitrogenation column, until the nitrogen content of the flow 9 becomes acceptable. Product 21, which comprises primarily carbon monoxide, is removed from the condenser 23.

Additionally or alternatively, it is possible to measure the nitrogen content of the mixture, or of a fluid from which the mixture is derived (for example natural gas) and to trigger the conveyance of nitrogen if this content is below a given threshold.

If not, it is possible to measure the flow rate of the fluid 9 feeding the denitrogenation column 11 and to trigger the conveyance of nitrogen if this content is below a given threshold.

Another alternative is to trigger the conveyance of nitrogen if the opening of the expansion valve 31 of the purge of a condenser of the denitrogenation column falls below a given threshold.

It will be understood that many additional changes in the details, materials, steps and arrangement of parts, which have been herein described in order to explain the nature of the invention, may be made by those skilled in the art within the principle and scope of the invention as expressed in the appended claims. Thus, the present invention is not intended to be limited to the specific embodiments in the examples given above.

What is claimed is:

1. A method for producing carbon monoxide by cryogenic distillation using an installation comprising a system of distillation columns fed with a mixture of at least hydrogen and carbon monoxide as the main components and at least part of the time nitrogen, the method comprising the steps of:

measuring a nitrogen content of the mixture or of a fluid from which the mixture is derived;

separating the mixture in a system of distillation columns comprising a denitrogenation column configured to produce a nitrogen-rich flow and a carbon monoxide-rich flow;

withdrawing the carbon monoxide-rich flow from the system of distillation columns to serve as the product; and introducing a nitrogen-rich fluid from a supplemental nitrogen source upstream of and/or into the denitrogenation column if the nitrogen content of the mixture or of a fluid from which the mixture is derived falls below a given threshold based on a value in which operation of the denitrogenation column would deteriorate, wherein the supplemental nitrogen source is different than the mixture source.

2. The method of claim 1, wherein the step of introducing a nitrogen-rich fluid comprises introducing the nitrogen-rich fluid into a flow feeding the denitrogenation column or introducing the nitrogen-rich fluid directly into the denitrogenation column.

3. The method of claim 1, wherein the nitrogen-rich fluid is introduced at a temperature above −170° C.

4. The method of claim 3, wherein the nitrogen-rich fluid is introduced at a temperature above 0° C.

5. The method of claim 1, further comprising the step of increasing the flow of the nitrogen-rich fluid from the supplemental nitrogen source if the nitrogen-rich flow is below a given flow rate.

6. The method of claim 1, wherein the system of distillation columns are configured to achieve partial condensation or methane washing upstream of the denitrogenation column.

7. The method of claim 1, further comprising the step of reducing the flow of nitrogen from the supplemental nitrogen source if the nitrogen content of the mixture is above the given threshold.

8. The method of claim 1, wherein the installation further comprises a controller configured to increase or decrease the flow of the nitrogen-rich fluid coming from the supplemental nitrogen source according to the measured nitrogen content of the mixture or of a fluid from which the mixture is derived.

9. The method of claim 1, wherein the installation further comprises a means for measuring:

i) the nitrogen content of the mixture, of a fluid from which the mixture is derived or of a fluid feeding the denitrogenation column, or ii) the purge flow rate of a condenser of the denitrogenation column or of the fluid feeding the denitrogenation column, or iii) the opening of an expansion valve of the purge of a condenser of the denitrogenation column.

10. A method for producing carbon monoxide by cryogenic distillation using an installation comprising a system of distillation columns fed with a mixture of at least hydrogen and carbon monoxide as the main components and at least part of the time nitrogen, the method comprising the steps of:

measuring a nitrogen content of the mixture or of a fluid from which the mixture is derived;

separating the mixture in a system of distillation columns comprising a denitrogenation column configured to produce a nitrogen-rich flow and a carbon monoxide-rich flow;

withdrawing the carbon monoxide-rich flow from the system of distillation columns to serve as the product;

providing a threshold based on a value in which operation of the denitrogenation column would deteriorate, for the nitrogen content of the mixture or of a fluid from which the mixture is derived;

determining whether the nitrogen content of the mixture or of a fluid from which the mixture is derived falls below the threshold; and introducing a nitrogen-rich fluid from a supplemental nitrogen source upstream of and/or into the denitrogenation column upon a condition in which the nitrogen content of the mixture or of a fluid from which the mixture is derived falls below the threshold, wherein the supplemental nitrogen source is different than the mixture source.

11. The method of claim 10, wherein the installation further comprises a controller configured to increase or decrease the flow of the nitrogen-rich fluid coming from the supplemental nitrogen source according to the measured nitrogen content of the mixture or of a fluid from which the mixture is derived.

12. The method of claim 10, further comprising the step of adjusting the flow rate of the nitrogen-rich fluid introduced from the supplemental nitrogen source upstream of and/or into the denitrogenation column.

13. A method for producing carbon monoxide by cryogenic distillation using an installation comprising a system of distillation columns fed with a mixture of at least hydrogen and carbon monoxide as the main components and at least part of the time nitrogen, the method comprising the steps of:

measuring a nitrogen content of the mixture or of a fluid from which the mixture is derived;

separating the mixture in a system of distillation columns comprising a denitrogenation column configured to produce a nitrogen-rich flow and a carbon monoxide-rich flow;

withdrawing the carbon monoxide-rich flow from the system of distillation columns to serve as the product; and adjusting a flow rate of a nitrogen-rich fluid that is introduced upstream of and/or into the denitrogenation column based on the measured nitrogen content of the mixture or of a fluid from Which the mixture is derived, wherein the nitrogen-rich fluid comes from a supplemental nitrogen source, wherein the supplemental nitrogen source is different than the mixture source.

14. The method of claim 13, wherein the installation further comprises a controller configured to increase or decrease the flow of the nitrogen-rich fluid coming from the supplemental nitrogen source according to the measured nitrogen content of the mixture or of a fluid from which the mixture is derived.

15. The method of claim 13, further comprising the step of providing a threshold based on a value in which operation of the denitrogenation column would deteriorate, for the nitrogen content of the mixture or of a fluid from Which the mixture is derived.

* * * * *